US011235572B2

(12) United States Patent
Takahashi

(10) Patent No.: US 11,235,572 B2
(45) Date of Patent: Feb. 1, 2022

(54) MEDIUM EJECTION APPARATUS

(71) Applicant: RISO KAGAKU CORPORATION, Tokyo (JP)

(72) Inventor: Hisayuki Takahashi, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 10 days.

(21) Appl. No.: 16/884,554

(22) Filed: May 27, 2020

(65) Prior Publication Data

US 2021/0060933 A1 Mar. 4, 2021

(30) Foreign Application Priority Data

Aug. 30, 2019 (JP) ..... JP2019-157685

(51) Int. Cl.

| | |
|---|---|
| ***B65H 31/34*** | (2006.01) |
| ***B41J 2/045*** | (2006.01) |
| ***B41J 2/175*** | (2006.01) |
| ***B41J 29/12*** | (2006.01) |
| ***B65H 31/00*** | (2006.01) |
| ***B65H 31/20*** | (2006.01) |

(52) U.S. Cl.

CPC ..... *B41J 2/04573* (2013.01); *B41J 2/04541* (2013.01); *B41J 2/175* (2013.01); *B41J 29/12* (2013.01); *B65H 31/00* (2013.01); *B65H 31/20* (2013.01); *B65H 31/34* (2013.01); *B41J 2/04593* (2013.01)

(58) Field of Classification Search

None

See application file for complete search history.

(56) References Cited

U.S. PATENT DOCUMENTS

| | | | | |
|---|---|---|---|---|
| 4,657,239 | A | 4/1987 | Ikesue et al. | |
| 6,382,616 | B1 * | 5/2002 | Waragai | B65H 9/04 270/58.08 |
| 9,809,408 | B2 | 11/2017 | Maenishi et al. | |
| 10,183,508 | B2 | 1/2019 | Itogawa et al. | |

(Continued)

FOREIGN PATENT DOCUMENTS

| | | |
|---|---|---|
| EP | 32993201 A1 | 3/2018 |
| JP | 05-008920 | 1/1993 |

OTHER PUBLICATIONS

Extended European Search Report, EPO, Application No. 20179078.9, dated Nov. 9, 2020.

*Primary Examiner* — Leslie A Nicholson, III

(74) *Attorney, Agent, or Firm* — Greenblum & Bernstein, P.L.C.

(57) ABSTRACT

A medium ejection apparatus includes a placement mount on which media are placed, a restriction part that moves between a restriction position at which the restriction part restricts media ejected toward the placement mount and a retracted position retracted from the restriction position, and a processor that controls the restriction part by adjusting a restriction frequency on the basis of at least either an amount of movement of the restriction part from the retracted position to the restriction position or ejection intervals at which the media are ejected toward the placement mount, the restriction frequency being a frequency with which the restriction part performs a restriction operation for the media.

2 Claims, 7 Drawing Sheets

(56) References Cited

U.S. PATENT DOCUMENTS

| | | | | |
|---|---|---|---|---|
| 2008/0067730 | A1* | 3/2008 | Suzuki | B65H 31/34 270/37 |
| 2010/0007074 | A1* | 1/2010 | Iguchi | B65H 29/34 270/58.08 |
| 2011/0062647 | A1* | 3/2011 | Tsuchiya | B65H 31/3027 270/58.09 |
| 2013/0001848 | A1* | 1/2013 | Hidaka | B65H 5/023 270/58.17 |
| 2014/0131940 | A1* | 5/2014 | Fukuda | B65H 31/34 271/220 |
| 2015/0003939 | A1* | 1/2015 | Abe | B42B 5/00 412/33 |
| 2015/0115516 | A1* | 4/2015 | Satoh | B65H 31/34 270/37 |
| 2018/0072084 | A1* | 3/2018 | Shimizu | B42C 1/00 |

* cited by examiner

MEDIUM EJECTION APPARATUS

CROSS-REFERENCE TO RELATED APPLICATION

This application is based upon and claims the benefit of priority of the prior Japanese Patent Application No. 2019-157685, filed on Aug. 30, 2019, the entire contents of which are incorporated herein by reference.

FIELD

The aspects described herein are related to a medium ejection apparatus in which media are placed.

BACKGROUND

Restriction parts such as side fences have conventionally been disposed around placement mounts on which media such as sheets are placed. A known medium ejection apparatus is such that the restriction part can move between a restriction position at which the restriction part abuts edge portions of media ejected toward a placement mount and thus restricts the placement position of the media and a retracted position retracted from the restriction position. The restriction part of such a medium ejection apparatus performs a restriction operation (jogger operation) wherein the restriction part moves from the retracted position to the restriction position when media are ejected toward the placement mount and then moves from the restriction position to the retracted position, so that the ejected media can be aligned.

A proposed sheet post-processing apparatus is such that the amount of pressing by a pressing means for pressing sheets placed on a tray is changed according to sheet conditions (see, for example, Japanese Laid-open Patent Publication No. 5-8920), although the abovementioned restriction operation is not performed.

SUMMARY

In one aspect, a medium ejection apparatus includes a placement mount on which media are placed, a restriction part that moves between a restriction position at which the restriction part restricts media ejected toward the placement mount and a retracted position retracted from the restriction position, and a processor that controls the restriction part by adjusting a restriction frequency on the basis of at least either the amount of movement of the restriction part from the retracted position to the restriction position or ejection intervals at which the media are ejected toward the placement mount, the restriction frequency being a frequency with which the restriction part performs a restriction operation for the media.

The object and advantages of the present invention will be realized by the elements recited in the claims and combinations thereof.

DESCRIPTION OF EMBODIMENTS

Figure 1:
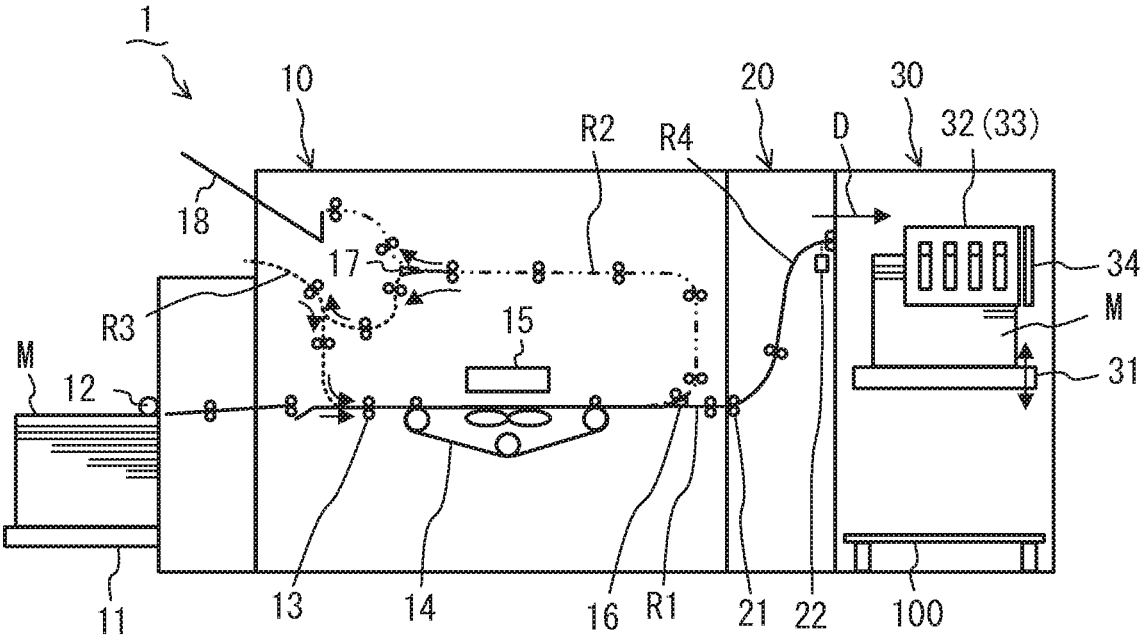
FIG. 1 illustrates the internal configuration of a printing system that includes a medium ejection apparatus in accordance with an embodiment.

In the meantime, for example, media consisting of thick paper may be tougher than thin paper and thus tend to be swiftly ejected toward a placement mount. Accordingly, when the media are thick paper, the amount of movement of the restriction part will desirably be increased by making the retracted position farther apart from the restriction position than in a situation in which the media are thin paper. In this way, the amount of movement of the restriction part may be changed according to the type of media.

However, as the amount of movement of the restriction part becomes larger, a restriction driver such as a motor for driving the restriction part will provide a longer driving time relative to a non-driving time, resulting in a larger amount of heat generation. As the ejection intervals at which media are ejected become shorter, the driving time of the restriction driver will be longer relative to the non-driving time, resulting in a larger amount of heat generation of the restriction driver.

Accordingly, the restriction operation will desirably be performed while reducing heat generation of the restriction driver so as to prevent, for example, the temperature thereof from reaching a specified temperature defined by the specifications.

The following describes a medium ejection apparatus in accordance with embodiments of the present invention by referring to the drawings.

FIG. 1 illustrates the internal configuration of a printing system 1 that includes a medium ejection apparatus 30 in accordance with an embodiment.

Figure 2:
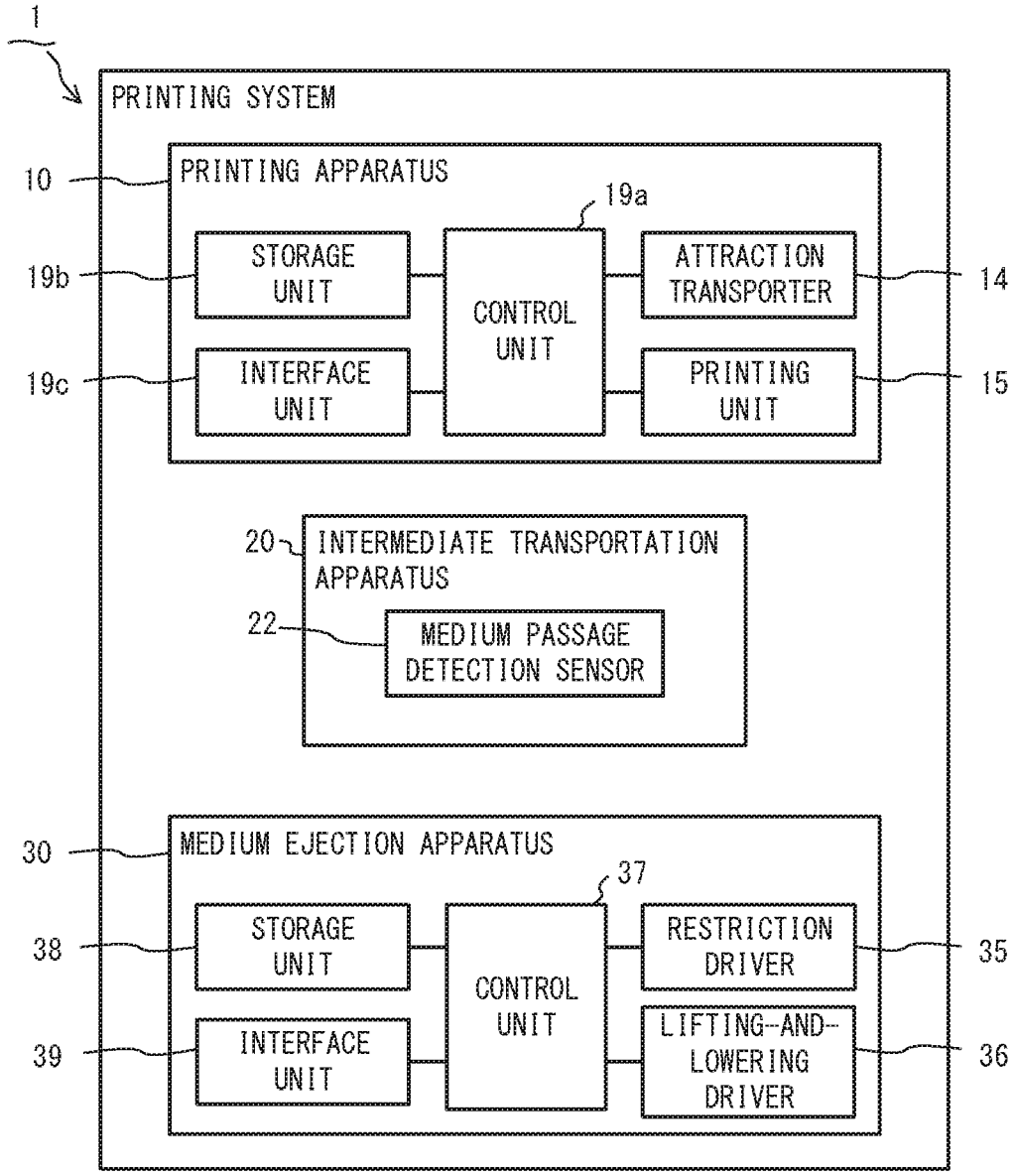
FIG. 2 illustrates main control components of a printing system that includes a medium ejection apparatus in accordance with an embodiment.

FIG. 2 illustrates main components of the printing system 1.

The printing system 1 depicted in FIGS. 1 and 2 includes a printing apparatus 10, an intermediate transportation apparatus 20, and a medium ejection apparatus 30.

In FIG. 1, solid lines indicate a straight transportation path R1 for media M within the printing apparatus 10 and an ejection path R4 for the media M within the intermediate transportation apparatus 20. In addition, FIG. 1 uses a two-dot dash line to indicate a circulation transportation path R2 for the media M within the printing apparatus 10 and uses a dashed line to indicate an inversion transportation path R3 within the printing apparatus 10. The media M are sheet-like media, e.g., flat paper (sheets).

As depicted in FIG. 1, the printing apparatus 10 includes a medium supply part 11, a drawing-out roller 12, a plurality of transportation roller pairs 13, an attraction transporter 14, a printing unit 15, transportation-path switching parts 16 and 17, and a placement mount 18. As depicted in FIG. 2, the printing apparatus 10 also includes a control unit 19*a*, a storage unit 19*b*, and an interface unit 19*c*.

Media M are placed on the medium supply part 11. The medium supply part 11 is disposed integrally with the printing apparatus 10 but may be separate from the printing apparatus 10.

The drawing-out roller 12 draws out and transports an uppermost medium M of the plurality of media M placed on the medium supply part 11.

A plurality of transportation roller pairs 13 are provided for each of the straight transportation path R1, the circulation transportation path R2, and the inversion transportation path R3 within the printing apparatus 10 and transport a medium M in a nipping manner.

The attraction transporter 14 faces the printing unit 15. The attraction transporter 14 transports a medium M by means of a belt while attracting the medium M.

The drawing-out roller 12, the plurality of transportation roller pairs 13, the attraction transporter 14, and a plurality of transportation roller pairs 21 in the intermediate transportation apparatus 20 (described hereinafter) are examples of transportation means for transporting media M.

For example, the printing unit 15 may include line-head-type inkjet heads (not illustrated) for various colors to be used in printing. The printing unit 15 may use a printing scheme other than the inkjet printing scheme.

The transportation-path switching part 16 switches the transportation path for a medium M that has undergone printing by the printing unit 15 between the straight transportation path R1 leading to the intermediate transportation apparatus 20 and the circulation transportation path R2 leading to the placement mount 18 or the inversion transportation path R3.

The transportation-path switching part 17 switches the circulation transportation path R2 for a medium M between a transportation path leading to the placement mount 18 and a transportation path leading to the inversion transportation path R3. The front and back sides of the medium M are inverted on the inversion transportation path R3, and then the medium M is transported again to the printing unit 15.

Media M not to be ejected to the medium ejection apparatus 30 are placed on the placement mount 18.

The control unit 19*a* depicted in FIG. 2 includes a processor (e.g., central processing unit (CPU)) that functions as an arithmetic processing apparatus for controlling the operations of the entirety of the printing apparatus 10 and controls the operations of components such as the attraction transporter 14 and the control unit 15. The control unit 19*a* also controls the plurality of transportation roller pairs 21 of the intermediate transportation apparatus 20 (described hereinafter). The printing system 1 may have disposed therein a control unit that serves as both the control unit 19*a* of the printing apparatus 10 and a control unit 37 for the medium ejection apparatus 30 (described hereinafter).

For example, the storage unit 19*b* may be a read only memory (ROM) that is a read-only semiconductor memory having a predetermined control program recorded therein in advance, or a random access memory (RAM) that is a randomly writable/readable semiconductor memory used as a working storage region on an as-needed basis when a processor executes various control programs.

The interface unit 19*c* communicates various information with devices such as the medium ejection apparatus 30. For example, the interface unit 19*c* may send medium-type information to the medium ejection apparatus 30. The medium-type information indicates, for example, the size of a medium M or the thickness thereof, i.e., whether the medium M is thick paper.

The intermediate transportation apparatus 20 depicted in FIG. 1 includes a plurality of transportation roller pairs 21 and a medium passage detection sensor 22.

The plurality of transportation roller pairs 21 transport, in a nipping manner, a medium M ejected from the printing apparatus 10.

The medium passage detection sensor 22 detects the presence/absence of a medium M on the ejection path R4.

As depicted in FIG. 1, the medium ejection apparatus 30 includes a placement mount 31, side restriction parts 32 and 33, and an end restriction part 34. As depicted in FIG. 2, the medium ejection apparatus 30 also includes a restriction driver 35, a lifting-and-lowering driver 36, a control unit 37, a storage unit 38, and an interface unit 39.

The medium ejection apparatus 30 is separate from the printing apparatus 10 but may be disposed integrally with the printing apparatus 10. The medium ejection apparatus 30 is disposed in the printing system 1 that includes the single printing apparatus 10 but may be disposed in, for example, a printing system that includes a plurality of printing apparatuses arranged in series with transportation paths for media M. The medium ejection apparatus 30 may have placed therewithin media M ejected from a processing apparatus for performing non-printing processing on the media M or from a transportation apparatus for transporting media M that have not undergone any processing, rather than media M ejected from the printing apparatus 10. When the intermediate transportation apparatus 20 is omitted, media M may be ejected from the printing apparatus 10 directly into the medium ejection apparatus 30.

Media M are placed on the placement mount 31. The placement mount 31 can be lifted or lowered by a driving operation performed by the lifting-and-lowering driver 36 (described hereinafter). The placement mount 31 is disposed in a removable manner within the medium ejection apparatus 30. When taking out media M, the placement mount 31 may be lowered onto a carriage 100 and taken out of the medium ejection apparatus 30 together with the media M. Alternatively, the placement mount 31 may be incapable of being lifted or lowered.

Figure 3:
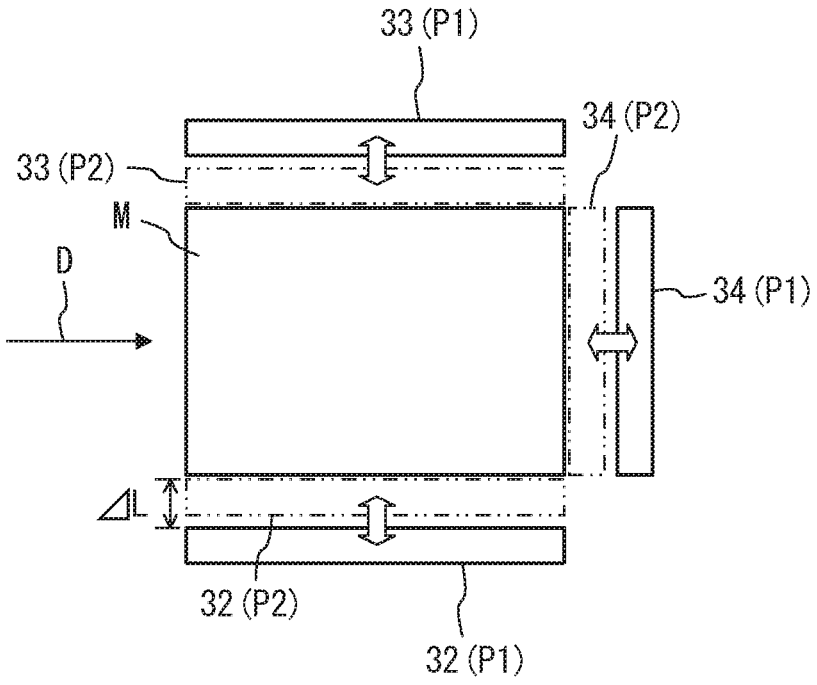
FIG. 3 is a plan view for illustrating a restriction operation performed by side restriction parts and an end restriction part in an embodiment.

As depicted in FIG. 3, the side restriction parts 32 and 33 are disposed to face each other in the width direction of a medium M that is orthogonal to an ejection direction D of the medium M being ejected toward the placement mount 31. For example, the side restriction parts 32 and 33 may be side fences.

The end restriction part 34 is located downstream in the ejection direction D (right side in FIG. 3) from the media M placed on the placement mount 31. For example, the end restriction part 34 may be an end fence.

The side restriction parts 32 and 33 and the end restriction part 34 are examples of restriction parts that move between restriction positions P2 indicated by two-dot dash lines in FIG. 3 at which the restriction parts abut end portions of media M ejected toward the placement mount 31 and thus restrict the placement position of the media M and retracted positions P1 retracted from the restriction positions P2. For example, all of the amounts (lengths) of movement of the side restriction parts 32 and 33 and the end restriction part 34 from the retracted positions P1 to the restriction positions P2 may be $\Delta L$, i.e., the same value. As will be described hereinafter in detail, the amount of movement $\Delta L$ is 6 millimeters when the media M are thick paper and is 3 millimeters when the media M are not thick paper. Accordingly, fixed positions dependent on the size of media M may be set as the restriction positions P2 of the side restriction parts 32 and 33 and the end restriction part 34, but the retraction positions P1 are varied with a variation in the amount of movement ΔL even when the size of media M is fixed.

The side restriction parts 32 and 33 and the end restriction part 34 perform a restriction operation (jogger operation) wherein these restriction parts move from the retracted positions P1 to the restriction positions P2 and then, without stopping at, for example, the restriction positions P2, move from the restriction positions P2 to the retracted positions P1. Thus, the restriction operation may be considered to be a shuttle operation of moving from the retracted positions P1 to the restriction positions P2 and returning to the retracted positions P1.

Unlike the placement mount 31, the side restriction parts 32 and 33 and the end restriction part 34 are not lifted or lowered by the lifting-and-lowering driver 36. At least either the side restriction parts 32 and 33 or the end restriction part 34 may move between the retracted position P1 and the restriction position P2 though a driving operation performed by the restriction driver 35 (described hereinafter).

The restriction driver 35 depicted in FIG. 2 is, for example, an actuator such as a motor. The restriction driver 35 drives the side restriction parts 32 and 33 and the end restriction part 34 so as to perform the restriction operation for a medium M in the process of being ejected. The restriction driver 35 may be a single driver for driving the side restriction parts 32 and 33 and the end restriction part 34 or may be a plurality of drivers each for driving any of the side restriction parts 32 and 33 and the end restriction part 34.

For example, the lifting-and-lowering driver 36 may be an actuator such as a motor. The lifting-and-lowering driver 36 lifts or lowers the placement mount 31 under the drive control performed by the control unit 37. The medium ejection apparatus 30 has disposed therein a placement-surface detection sensor (not illustrated) for detecting that the height of the placement surface of media M on the placement mount 31 has reached a predetermined height. On the basis of the detection result provided by the placement-surface detection sensor, the control unit 37 may control the lifting-and-lowering driver 36 so as to lower the placement mount 31 by, for example, a height corresponding to a predetermined number of sheets.

The control unit 37 includes a processor (e.g., CPU) that functions as an arithmetic processing apparatus for controlling the operations of the entirety of the medium ejection apparatus 30. As will be described hereinafter, on the basis of at least either the amount of movement ΔL of the side restriction parts 32 and 33 and the end restriction part 34 from the retracted positions P1 to the restriction positions P2 or the ejection intervals at which media M are ejected toward the placement mount 31, the control unit 37 controls the side restriction parts 32 and 33 and the end restriction part 34 (restriction driver 35) by adjusting a restriction frequency (jogger frequency) that is a frequency with which the side restriction parts 32 and 33 and the end restriction part 34 perform the restriction operation for the media M. The restriction frequency may indicate the ratio of media M to be subjected to the jogger operation, e.g., every medium M or one out of every two media M.

For example, the storage unit 38 may be a ROM that is a read-only semiconductor memory having a predetermined control program recorded therein in advance, or a RAM that is a randomly writable/readable semiconductor memory used as a working storage region on an as-needed basis when a processor executes various control programs.

The interface unit 39 communicates various information with devices such as the printing apparatus 10 and the intermediate transportation apparatus 20. For example, the interface unit 39 may obtain a detection result provided by the medium passage detection sensor 22. For media M to be subjected to the restriction operation performed by the side restriction parts 32 and 33 and the end restriction part 34, the control unit 37 controls the restriction driver 35 such that the restriction operation is performed when a predetermined time period (e.g., several hundred milliseconds) has elapsed after the media M passed the medium passage detection sensor 22.

Figure 4:
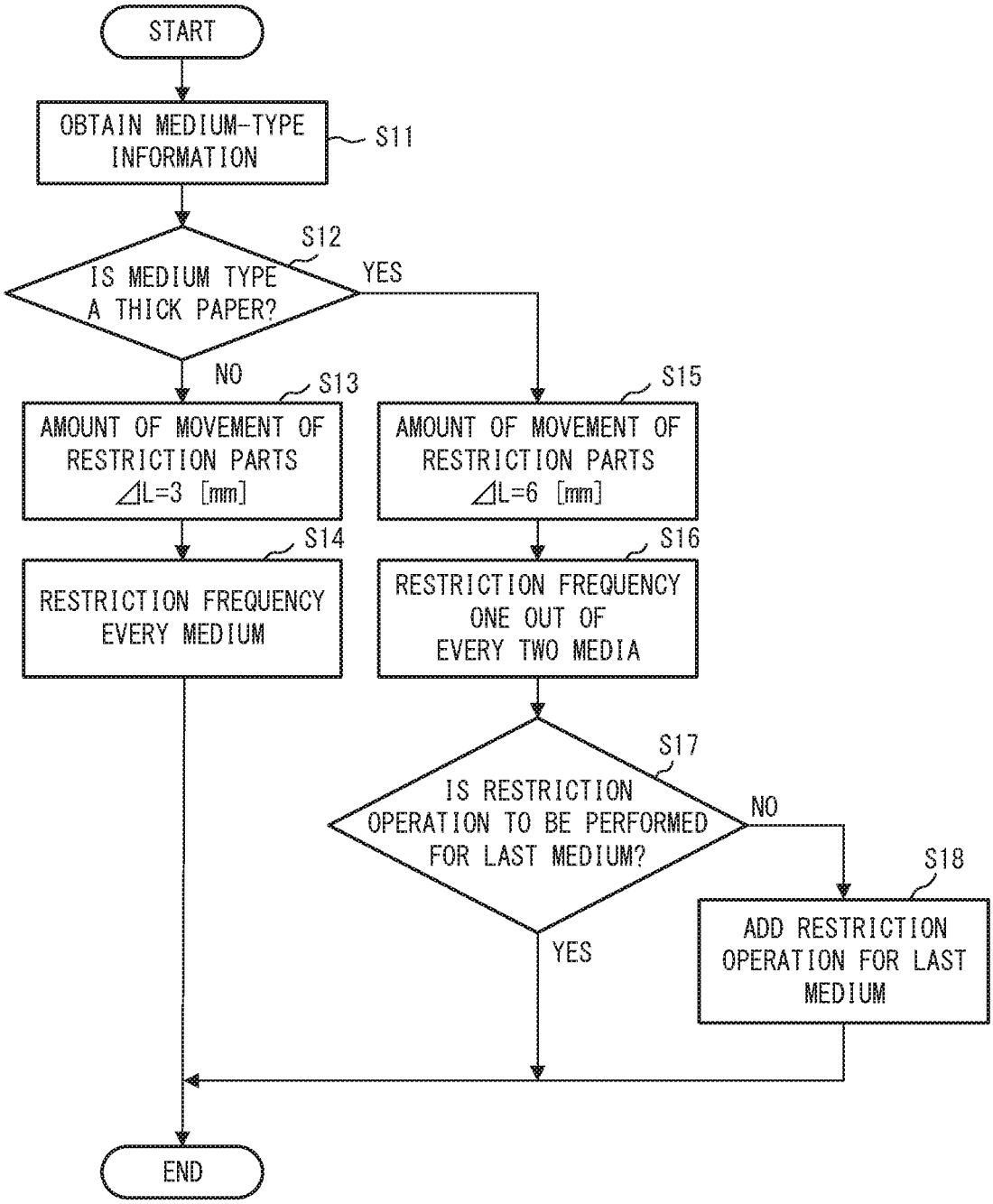
FIG. 4 is a flowchart for illustrating a decision process (first example) for a restriction frequency in an embodiment.

FIG. 4 is a flowchart for illustrating a decision process (first example) for a restriction frequency in embodiments.

Regarding the first example, descriptions are given of an example in which the control unit 37 decides on a restriction frequency on the basis of the amount of movement ΔL of the side restriction parts 32 and 33 and the end restriction part 34 from the retracted positions P1 to the restriction position P2. The processes in the flowchart depicted in FIG. 4 are performed by the control unit 37 of the medium ejection apparatus 30 depicted in FIG. 1 when, for example, information indicating that the printing apparatus 10 has received a printing start instruction is received from the printing apparatus 1 (or before media M are ejected toward the placement mount 31). Note that descriptions of matters that have already been described above will be omitted, as appropriate, in the following.

The control unit 37 obtains a thickness as to whether media M are thick paper from information set by, for example, a print job provided by the printing apparatus 10 (step S11). The thickness is an example of medium-type information, and the medium-type information may be the size of a medium M. The medium-type information is not limited to information set by a print job and may be information set by operating an input unit provided for the printing apparatus 10 (or the printing system 1).

The control unit 37 determines whether the media M are thick paper (step S12). When the media Mare not thick paper (step S12: NO), i.e., when the media M have a standard thickness or are thin paper, the control unit 37 decides that the amount of movement ΔL of the side restriction parts 32 and 33 and the end restriction part 34 is to be 3 millimeters (step S13). Accordingly, the retracted positions P1 and the restriction positions P2 of the side restriction parts 32 and 33 and the end restriction part 34 are set in accordance with the size of the media M in a manner such that the amount of movement ΔL of the side restriction parts 32 and 33 and the end restriction part 34 are 3 millimeters.

The control unit 37 decides on a restriction frequency with which the side restriction parts 32 and 33 and the end restriction part 34 perform the restriction operation, such that every medium M, i.e., all of the media M, is to be subjected to the restriction operation (step S14) and ends the processes depicted in FIG. 4.

In the above-described step S12, when the media M are thick paper (step S12: YES), the control unit 37 decides that the amount of movement ΔL of the side restriction parts 32 and 33 and the end restriction part 34 is to be 6 millimeters (step S15).

The control unit 37 decides on the restriction frequency with which the side restriction parts 32 and 33 and the end restriction part 34 perform the restriction operation, such that one out of every two media M is to be subjected to the restriction operation (step S16). The restriction frequency is decreased when the amount of movement ΔL is 6 millimeters in comparison to when the amount of movement ΔL is 3 millimeters, because as the amount of movement ΔL becomes larger, the driving time of the restriction driver 35 will be longer relative to the non-driving time, resulting in a larger amount of heat generation of the restriction driver 35. The possible values for the amount of movement ΔL are not limited to the two lengths, i.e., 3 millimeters and 6 millimeters, but three or more lengths based on the medium-type information may be such possible values. In addition, three or more possible restriction frequencies may be determined in accordance with the three or more possible values for the amount of movement ΔL.

The control unit 37 determines whether the last medium M before the stopping of the ejection of the media M (e.g., the medium M at the end of the print job) is to be subjected to the restriction operation (step S17).

When, for example, ten media Mare ejected with second, fourth, sixth, eighth, and tenth media M scheduled to be subjected to the restriction operation, the control unit 37 determines that the restriction operation is to be performed for the last tenth medium M (step S17: YES) and ends the processes depicted in FIG. 4.

When, for example, nine media M are ejected with second, fourth, sixth, and eighth media M scheduled to be subjected to the restriction operation, the control unit 37 determines that the restriction operation is not to be performed for the last ninth medium M (step S17: NO). In this case, the control unit 37 adds the restriction operation for the ninth medium M in a manner such that the restriction operation is performed for the last ninth medium M and controls the restriction driver 35 so as to perform the restriction operation for the second, fourth, sixth, eighth, and ninth media M (step S18) and ends the processes depicted in FIG. 4.

Instead of adding the restriction operation for the last medium M, the control unit 37 may control the restriction driver 35, with the media M to be subjected to the restriction operation switched such that the restriction operation is performed for the first, third, fifth, seventh, and ninth media M, rather than for the second, fourth, sixth, and eighth media M, so that the last ninth medium M can be subjected to the restriction operation. Alternatively, instead of adding the restriction operation for the last medium M, the control unit 37 may control the restriction driver 35 with the eighth medium M replaced with the ninth medium M such that the restriction operation is performed for the second, fourth, sixth, and ninth media M, rather than for the second, fourth, sixth, and eighth media M, so that the last ninth medium M can be subjected to the restriction operation. Although the restriction operation will desirably be performed for the last medium M, the processes of steps S17 and S18 may be omitted.

Figure 5:
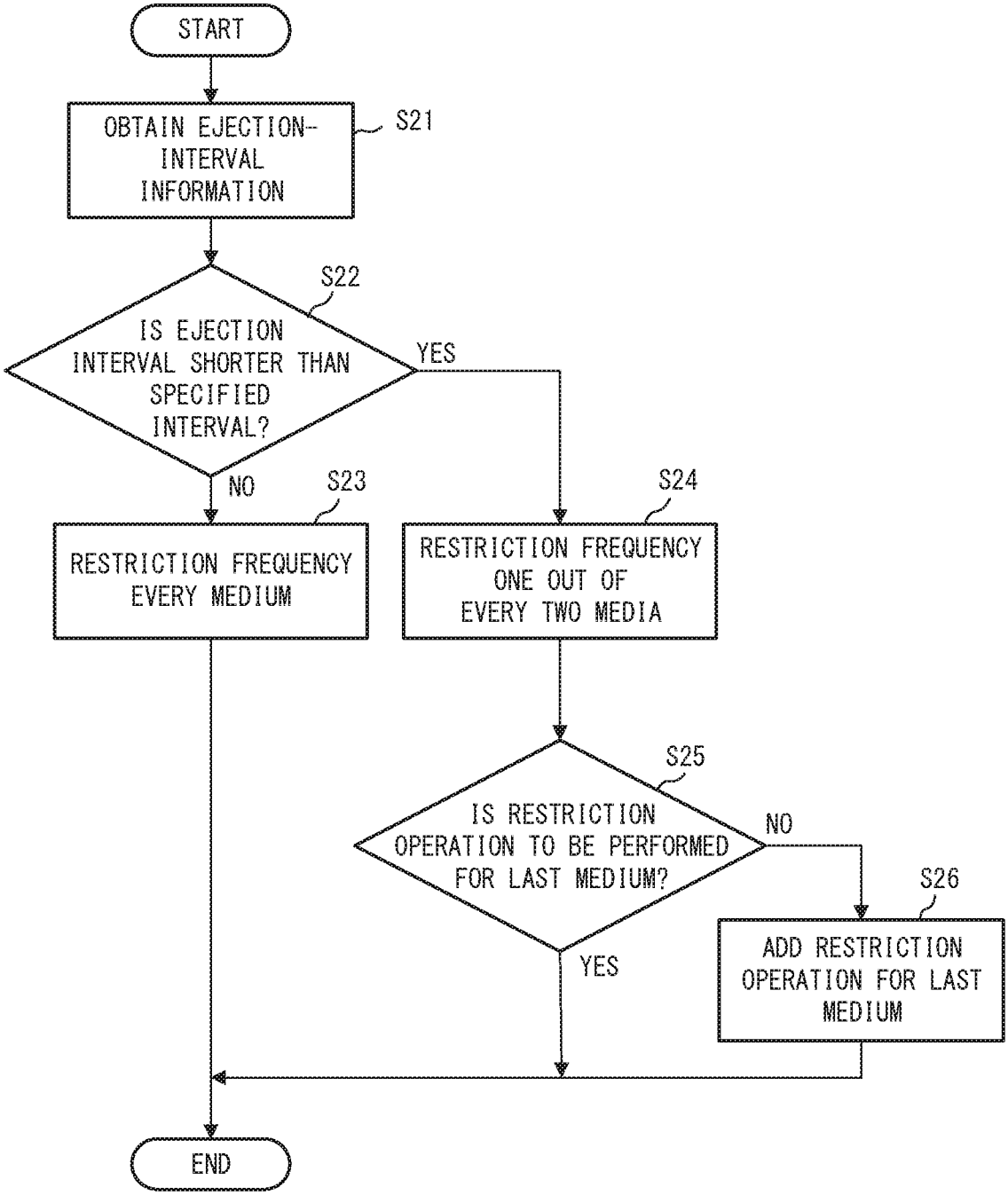
FIG. 5 is a flowchart for illustrating a decision process (second example) for a restriction frequency in an embodiment.

FIG. 5 is a flowchart for illustrating a decision process (second example) for a restriction frequency in embodiments.

Regarding the second example, descriptions are given of an example in which the control unit 37 decides on a restriction frequency on the basis of ejection intervals at which media M are ejected.

The control unit 37 obtains the ejection intervals for media M (step S21). For example, the ejection intervals may be calculated on the basis of the transportation velocity of the media M, the size of the media M, and the spaces between media M when being successively transported. The ejection intervals become shorter as the transportation velocity of media M becomes higher, as the size of the media M becomes smaller (as the length in the ejection direction D becomes shorter), or as the spaces between media M when being successively transported become narrower.

The control unit 37 determines whether the ejection interval is shorter than an interval specified in advance (step S22). When determining that the interval is not shorter (step S22: NO), the control unit 37 decides on a restriction frequency with which the side restriction parts 32 and 33 and the end restriction part 34 perform the restriction operation, such that every medium M, i.e., all of the media M, is to be subjected to the restriction operation (step S23) and ends the processes depicted in FIG. 5. For example, the amount of movement ΔL of the side restriction parts 32 and 33 and the end restriction part 34 may be fixed irrespective of the ejection interval.

When determining that the ejection interval is shorter than the specified interval (step S22: YES), the control unit 37 decides on a restriction frequency with which the side restriction parts 32 and 33 and the end restriction part 34 perform the restriction operation, such that one out of every two media M is to be subjected to the restriction operation (step S24). In this regard, the restriction frequency is decreased when the ejection interval is shorter than the specified interval, because the driving time of the restriction driver 35 will be longer relative to the non-driving time, resulting in a larger amount of heat generation of the restriction driver 35.

The control unit 37 determines whether the last medium M before the stopping of the ejection of the media M (e.g., the medium M at the end of the print job) is to be subjected to the restriction operation (step S25). When the last medium M is to be subjected to the restriction operation (step S25: YES), the control unit 37 ends the processes depicted in FIG. 5.

As described above with reference to the first example depicted in FIG. 4, when the last medium M is not to be subjected to the restriction operation (step S25: NO), the restriction driver 35 is controlled to cause the side restriction parts 32 and 33 and the end restriction part 34 to perform the restriction operation for the last medium M (step S26), and the processes depicted in FIG. 5 are ended.

Figure 6:
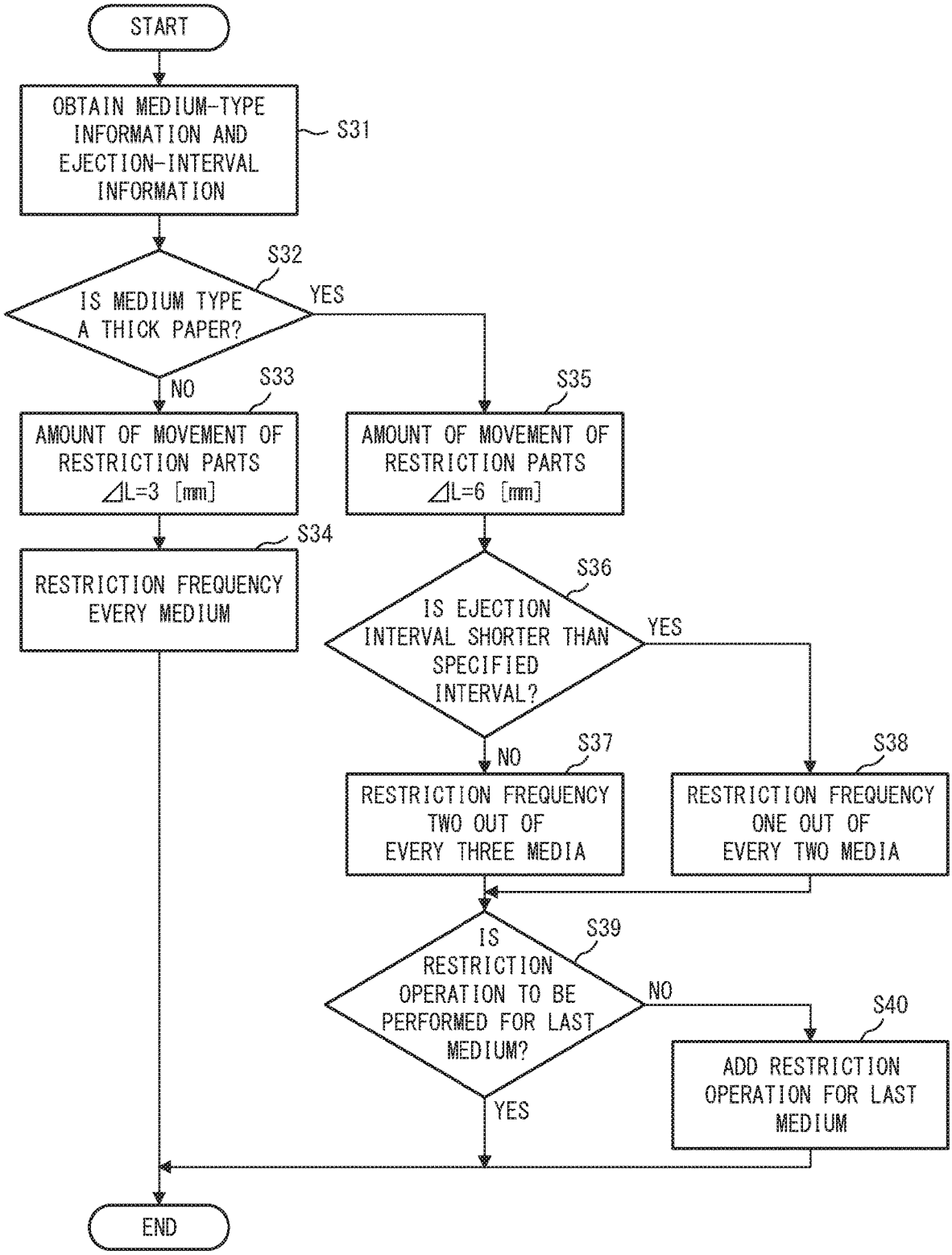
FIG. 6 is a flowchart for illustrating a decision process (third example) for a restriction frequency in an embodiment.

FIG. 6 is a flowchart for illustrating a decision process (third example) for a restriction frequency in embodiments.

Regarding the third example, descriptions are given of an example in which the control unit 37 decides on a restriction frequency on the basis of both the amount of movement ΔL of the side restriction parts 32 and 33 and the end restriction part 34 (see the first example from FIG. 4) and the ejection intervals at which media M are ejected (see the second example from FIG. 5).

The control unit 37 obtains the thickness (medium-type information) and ejection interval of media M from information set by, for example, a print job provided by the printing apparatus 10. (step S31).

The control unit 37 determines whether the media M are thick paper (step S32). When the media M are not thick paper (step S32: NO), the control unit 37 decides that the amount of movement ΔL of the side restriction parts 32 and 33 and the end restriction part 34 is to be 3 millimeters (step S33).

The control unit 37 decides on a restriction frequency with which the side restriction parts 32 and 33 and the end restriction part 34 perform the restriction operation, such that every medium M, i.e., all of the media M, is to be subjected to the restriction operation (step S34) and ends the processes depicted in FIG. 6.

In the above-described step S32, when the media M are thick paper (step S32: YES), the control unit 37 decides that the amount of movement ΔL of the side restriction parts 32 and 33 and the end restriction part 34 is to be 6 millimeters (step S35).

The control unit 37 determines whether the ejection interval is shorter than an interval specified in advance (step S36). When determining that the interval is not shorter (step S36: NO), the control unit 37 decides on a restriction frequency with which the side restriction parts 32 and 33 and the end restriction part 34 perform the restriction operation, such that two out of every three media M are to be subjected to the restriction operation, i.e., a process of performing the restriction operation for two media M and skipping the restriction operation for one media M is repeatedly performed (step S37). When determining that the ejection interval is shorter than the specified interval (step S36: YES), the control unit 37 decides on a restriction frequency such that one out of every two media M is to be subjected to the restriction operation (step S38).

The control unit 37 determines whether the last medium M before the stopping of the ejection of the media M (e.g., the medium M at the end of the print job) is to be subjected to the restriction operation (step S39). When the last medium M is to be subjected to the restriction operation (step S39: YES), the control unit 37 ends the processes depicted in FIG. 6.

As described above with reference to the first example depicted in FIG. 4, when the last medium M is not to be subjected to the restriction operation (step S39: NO), the restriction driver 35 is controlled to cause the side restriction parts 32 and 33 and the end restriction part 34 to perform the restriction operation for the last medium M (step S40), and the processes depicted in FIG. 6 are ended.

Figure 7:
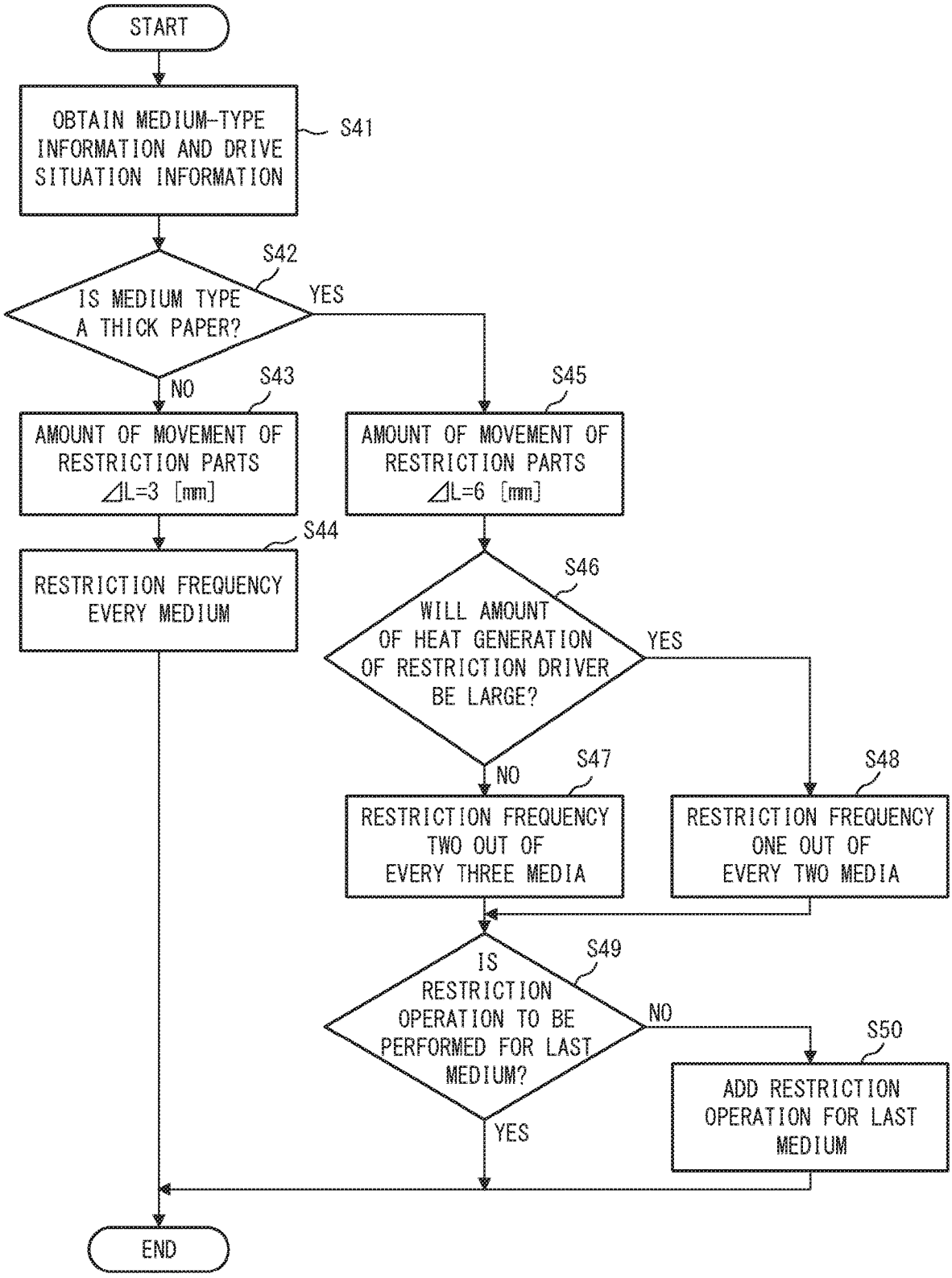
FIG. 7 is a flowchart for illustrating a decision process (fourth example) for a restriction frequency in an embodiment.

FIG. 7 is a flowchart for illustrating a decision process (fourth example) for a restriction frequency in embodiments.

Regarding the fourth example, descriptions are given of an example in which the control unit 37 decides on a restriction frequency on the basis of the amount of movement ΔL of the side restriction parts 32 and 33 and the end restriction part 34 and a drive situation of the restriction driver 35.

The control unit 37 obtains the thickness (medium-type information) of media M from information set by, for example, a print job provided by the printing apparatus 10 and also obtains, for example, drive situation information of the restriction driver 35 for a certain period in the past (step S41).

The control unit 37 determines whether the media M are thick paper (step S42). When the media M are not thick paper (step S42: NO), the control unit 37 decides that the amount of movement ΔL of the side restriction parts 32 and 33 and the end restriction part 34 is to be 3 millimeters (step S43).

The control unit 37 decides on a restriction frequency with which the side restriction parts 32 and 33 and the end restriction part 34 perform the restriction operation, such that every medium M, i.e., all of the media M, is to be subjected to the restriction operation (step S44) and ends the processes depicted in FIG. 7.

In the above-described step S42, when the media M are thick paper (step S42: YES), the control unit 37 decides that the amount of movement ΔL of the side restriction parts 32 and 33 and the end restriction part 34 is to be 6 millimeters (step S45).

On the basis of, for example, the proportion of the driving period of the restriction driver 35 in the certain period in the past, the control unit 37 determines whether the drive situation of the restriction driver 35 involves a large amount of heat generation of the restriction driver 35 (step S46). The control unit 37 may determine whether the amount of heat generation of the restriction driver 35 will be large, by estimating the drive situation of the restriction driver 35 in the future (or the drive situations in both the past and the future) on the basis of the number of media M to be ejected at a later time or the like, or by measuring the temperature of the restriction driver 35.

When determining that the amount of heat generation of the restriction driver 35 is not large (step S46: NO), the control unit 37 decides on a restriction frequency with which the side restriction parts 32 and 33 and the end restriction part 34 perform the restriction operation, such that two out of every three media M are subjected to the restriction operation, i.e., a process of performing the restriction operation for two media M and skipping the restriction operation for one media M is repeatedly performed (step S47). When determining that the amount of heat generation of the restriction driver 35 is large (step S46: YES), the control unit 37 decides on a restriction frequency such that one out of every two media M is to be subjected to the restriction operation (step S48). Note that three or more possible restriction frequencies may be determined in accordance with the drive situation of the restriction driver 35.

The control unit 37 determines whether the last medium M before the stopping of the ejection of the media M (e.g., the medium M at the end of the print job) is to be subjected to the restriction operation (step S49). When the last medium M is to be subjected to the restriction operation (step S49: YES), the control unit 37 ends the processes depicted in FIG. 7.

As described above with reference to the first example depicted in FIG. 4, when the last medium M is not to be subjected to the restriction operation (step S49: NO), the restriction driver 35 is controlled to cause the side restriction parts 32 and 33 and the end restriction part 34 to perform the restriction operation for the last medium M (step S50), and the processes depicted in FIG. 7 are ended.

Regarding the fourth example of the decision process for a restriction frequency depicted in FIG. 7, descriptions have been given of the example in which the control unit 37 decides on a restriction frequency on the basis of the amount of movement ΔL of the side restriction parts 32 and 33 and the end restriction part 34 and the drive situation of the restriction driver 35. However, the control unit 37 may decide on a restriction frequency on the basis of the ejection intervals at which media M are ejected (see the second example depicted in FIG. 5) and the drive situation of the restriction driver 35 or on the basis of the drive situation of the restriction driver 35 and both the amount of movement ΔL and the ejection intervals at which media M are ejected (see the third example depicted in FIG. 6).

In the embodiments described so far, the medium ejection apparatus 30 includes: the placement mount 31; the side restriction parts 32 and 33 and the end restriction part 34, i.e., examples of the restriction part; and the control unit 37. Media M are placed on the placement mount 31. The side restriction parts 32 and 33 and the end restriction part 34 move between restriction positions P2 at which the restriction parts restrict media M ejected toward the placement mount 31 and the retracted positions P1 retracted from the restriction positions P2. On the basis of at least either the amount of movement ΔL of the side restriction parts 32 and 33 and the end restriction part 34 from the retracted positions P1 to the restriction positions P2 or ejection intervals at which media M are ejected toward the placement mount 31, the control unit 37 controls the side restriction parts 32 and 33 and the end restriction part 34 (restriction driver 35) by adjusting a restriction frequency with which the side restriction parts 32 and 33 and the end restriction part 34 perform the restriction operation for the media M.

In the meantime, as the amount of movement ΔL of the side restriction parts 32 and 33 and the end restriction part 34 increases, the driving time of the restriction driver 35 will be longer relative to the non-driving time, resulting in a larger amount of heat generation of the restriction driver 35. As the ejection intervals at which media M are ejected become shorter, the driving time of the restriction driver 35 will be longer relative to the non-driving time, resulting in a larger amount of heat generation of the restriction driver 35. Accordingly, for example, the restriction frequency may be decreased as the amount of movement ΔL increases or as the ejection interval of media M becomes shorter, so as to prevent the temperature of the restriction driver 35 (motor) from reaching a specified temperature (e.g., an upper-limit temperature designated by the specification or a lower temperature), so that heat generation of the restriction driver 35 can be reduced. In this way, embodiments allow for a reduction in heat generation of the restriction driver 35.

In embodiments, the control unit 37 controls the side restriction parts 32 and 33 and the end restriction part 34 (restriction driver 35) by adjusting the restriction frequency in a manner such that the side restriction parts 32 and 33 and the end restriction part 34 perform the restriction operation for the last medium M. Performing the restriction operation for the last medium M allows the placement position of the uppermost one of the media M placed on the placement mount 31 to be prevented from tending to be offset, unlike in situations in which the jogger operation is not performed for following media M.

In embodiments, the medium ejection apparatus 30 further includes the restriction driver 35 that drives the side restriction parts 32 and 33 and the end restriction part 34; and as seen in the fourth example of the decision process for the restriction frequency depicted in FIG. 7, the control unit 37 controls the side restriction parts 32 and 33 and the end restriction part 34 (restriction driver 35) by adjusting the restriction frequency on the basis of the drive situation of the restriction driver 35 and at least either the amount of movement ΔL of the side restriction parts 32 and 33 and the end restriction part 34 or ejection intervals at which media M are ejected. Accordingly, heat generation of the restriction driver 35 can be reduced by decreasing the restriction frequency when the amount of heat generation of the restriction driver 35 is large due to, for example, a multitude of media M being successively ejected.

The present invention is not simply limited to the embodiments described herein. Components of the embodiments may be embodied in a varied manner in an implementation phase without departing from the gist of the invention. A plurality of components disclosed with reference to the described embodiments may be combined, as appropriate, to achieve various inventions. For example, all of the components indicated with reference to embodiments may be combined as appropriate. Accordingly, various variations and applications can be provided, as a matter of course, without departing from the gist of the invention. The following indicates, as appendixes, the inventions recited in the claims of the Japanese application as originally filed.

According to one aspect, the application relates to a medium ejection apparatus comprising:

a placement mount on which media are placed;

a restriction part that moves between a restriction position at which the restriction part restricts media ejected toward the placement mount and a retracted position retracted from the restriction position; and a control unit that controls the restriction part by adjusting a restriction frequency on the basis of at least either an amount of movement of the restriction part from the retracted position to the restriction position or ejection intervals at which the media are ejected toward the placement mount, the restriction frequency being a frequency with which the restriction part performs a restriction operation for the media.

According to another aspect, in the medium ejection apparatus the control unit controls the restriction part by adjusting the restriction frequency in a manner such that the restriction part performs the restriction operation for a last medium of the media.

According to another aspect, the medium ejection apparatus further comprises a restriction driver that drives the restriction part, wherein the control unit controls the restriction part by adjusting the restriction frequency on the basis of a drive situation of the restriction driver and at least either the amount of movement of the restriction part or the ejection intervals at which the media are ejected.

What is claimed is:

1. A medium ejection apparatus comprising:

a placement mount on which media are placed;

a restriction part that moves between a restriction position at which the restriction part restricts media ejected toward the placement mount and a retracted position retracted from the restriction position;

a restriction driver that drives the restriction part; and a processor that is configured to control the restriction part by adjusting a restriction frequency on the basis of an amount of heat generation of the restriction driver and at least either an amount of movement of the restriction part from the retracted position to the restriction position or ejection intervals at which the media are ejected toward the placement mount, the restriction frequency being a frequency with which the restriction part performs a restriction operation for the media.

2. The medium ejection apparatus of claim 1, wherein the processor is further configured to control the restriction part by adjusting the restriction frequency in a manner such that the restriction part performs the restriction operation for a last medium of the media.

* * * * *